US006092612A

United States Patent [19]

Brady

[11] Patent Number: 6,092,612

[45] Date of Patent: Jul. 25, 2000

[54] ROTARY DRILLING SYSTEMS

[76] Inventor: William J. Brady, 1767 Wishingwell Dr., Creve Coeur, Mo. 63141

[21] Appl. No.: 09/046,382

[22] Filed: Mar. 23, 1998

Related U.S. Application Data

[63] Continuation-in-part of application No. 08/689,667, Aug. 13, 1996, Pat. No. 5,875,858, which is a continuation-in-part of application No. 08/472,913, Jun. 7, 1995, abandoned.

[51] Int. Cl.[7] ..... E21B 17/10

[52] U.S. Cl. ..... 175/325.2; 175/415; 175/417; 279/103; 403/383

[58] Field of Search ..... 175/162, 320, 175/415, 417, 418, 420.1, 325.2, 393; 279/103; 403/383

[56] References Cited

U.S. PATENT DOCUMENTS

| | | | |
|---|---|---|---|
| 3,554,306 | 1/1971 | Wilburn | 175/417 X |
| 4,099,585 | 7/1978 | Emmerich | 175/418 X |
| 4,165,790 | 8/1979 | Emmerich | 175/420.1 |
| 4,190,128 | 2/1980 | Emmerich | 175/420.1 |
| 4,515,230 | 5/1985 | Means et al. | 175/420.1 |
| 4,549,613 | 10/1985 | Case | 175/406 X |
| 4,632,195 | 12/1986 | Emmerich | 175/320 |

*Primary Examiner*—Roger Schoeppel
*Attorney, Agent, or Firm*—Richard G. Heywood

[57] ABSTRACT

A rotary system having a sectional drill steel column connecting a drilling machine and rotary drill bit and being constructed and arranged to accommodate internal fluid flow to the drill bit without pressure loss, and which column employs a coupler section having both threaded and multi-faced ends for joining adjacent drill steel sections; and further having supplemental bore reamers adjacent to the drill bit to maintain design bore dimensions and accommodate fluid flow and removal of cuttings.

21 Claims, 5 Drawing Sheets

ROTARY DRILLING SYSTEMS

This application is a continuation-in-part of my patent application Ser. No. 08/689,667 filed Aug. 13, 1996 and entitled Low Volume Air-Water Drilling Systems and Methods, now U.S. Pat. No. 5,875,858 which is a continuation-in-part of patent application Ser. No. 08/472,913 filed Jun. 7, 1995 (now abandoned).

BACKGROUND OF THE INVENTION

1. Field of the Invention

The invention relates generally to rotary drag bits, and more specifically to improvements in roof drill bit systems for drilling and boring as in roof bolting operations for tunnel construction and mining.

2. Description of the Prior Art

In the fields of industrial, mining and construction tools, polycrystalline diamond (PCD) is becoming more widely used in making cutting tool inserts, sometimes called polycrystalline diamond compacts (PDC). PCD materials are formed of fine diamond powder sintered by intercrystalline bonding under high temperature/high pressure diamond synthesis technology into a predetermined layer or shape; and such PCD layers are usually permanently bonded to a substrate of "precemented" tungsten carbide to form such PDC insert or compact. The term "high density ceramic" (HDC) is sometimes used to refer to a mining tool having an insert with a PCD layer. The term "chemical vapor deposition" (CVD) is a form of pure PCD that may be used for denser inserts and other super abrasive hard surfacing and layering materials, such as layered "nitride" compositions of titanium (TiN) and carbon ($C_2N_2$), are gaining acceptance in the mining field. All such "hard surface" materials—PCD, CVD and nitride compositions as well as titanium carbide and other more conventional bit materials are applicable to the present invention and considered alternatives unless specifically distinguished from each other herein. Some of the basic underlying technology pertaining to PCD materials is disclosed in U.S. Pat. Nos. 4,525,178; 4,570,726; 4,604,106; and 4,694,918.

The principal types of drill bits used in rotary drilling operations are roller bits and drag bits. In roller bits, rolled cones are secured in sequences on the bit to form cutting teeth to crush and break up rock and earth material by compressive force as the bit is rotated at the bottom of the bore hole. In drag bits, PCD cutting elements on the bit act to cut or shear the earth material. The action of some flushing fluid medium, such as fluid drilling mud, water or a compressed air/vacuum system, is important in all types of drilling operations to cool the cutting elements and to flush or transport cuttings away from the cutting elements and remove them from the hole. It is important to remove cuttings to prevent accumulations that may plug water passages and "ball up" or otherwise interfere with the crushing or cutting action of the bit, and the cooling action is particularly important in the use of PCD/CVD cutters to prevent carbon transformation of the diamond material.

Roof drill bits are a form of rotary drag bit and are used in roof bolting operations, which are overhead so the drilling operation is upward. In most cases the earth structure is formed of extremely hard rock or mineral (coal) deposits, although stratas of shale, loose (fractured) rock and mud layers are frequently encountered in boring or drilling operations for roof bolting construction. The use of large quantities of water (drilling mud) is typical in roof drilling to cool the cutting elements and flush the cuttings away, but overhead irrigation results in uncontrolled water loss and floor flooding that make working conditions unsafe and unpleasant. It should also be recognized that the presence of methane gas in coal mines and the like constitutes a safety hazard, and respirable dust is a further safety consideration in the mining industry. In a typical roof bolting operation, a series of 4 foot to 6 foot holes having a diameter of ¾ inch to 2 inches (or more) are drilled in the tunnel roof to receive bolts for anchoring roof support structures. In the past tungsten carbide bits frequently could only drill a single 4 foot hole before the bit became dull or broken. It should be noted also that where long flexible cable roof bolts are used as for some soft earth formations, 12 foot to 24 foot holes may be required and it may take up to 30 minutes to drill a single hole using prior art tungsten carbide drill bits.

My prior U.S. Pat. Nos. 5,180,022; 5,303,787 and 5,383,526 disclose substantial improvements in HCD roof drill bits using PCD cutting elements constructed in a non-coring arrangement, and also teach novel drilling methods that greatly accelerate the speed of drilling action and substantially reduce bit breakage and change-over downtime. My prior HCD non-coring drill bits are capable of drilling over 100–300 holes of 4 foot depth with a single bit and in shorter times with less thrust than the standard carbide bits in hard rock formations of 22,000–28,000 psi. However, although my prior HCD non-coring bits easily drill through earth structures that include shale, mud seams and other broken and soft formations, it has been discovered that these drill bits tend to plug in drilling through mud seams and other soft or broken earth formations and PCD cutting inserts may even shatter in working through stratas of extremely hard, fractured and muddy earth conditions.

Comparative tests conducted in three states have determined that the amount of water required to wet drill with PCD rotary bits may be reduced from a conventional (tungsten carbide bit) range of 9–18 gallons per minutes down to about 1–3 quarts per minutes when atomized into an air mist that effectively scours and cools the PCD inserts. Wet drilling in non-recoverable drilling operations currently being used achieves a penetration of 6–9 ft./min. requiring 6–9 gal./min. at 90 psi or 9–14 gal./min. at 150 psi or 18 gal./min. at 300 psi. Experimental testing in West Virginia was in fairly solid, 65% quartz sandstone with some 4 inch mud seams using HDC rotary bits and in air-water jet mist; the result achieved a penetration rate of 12 ft./min. with no plugging as compared with usual 6–9 ft./min. penetration using only water as the flushing agent. In Utah, experimental testing was conducted in a very muddy sandstone top with 20% silica content using 1 1/32 inch HDC of drill bits and 100–120 psi air-water mist. Prior conventional drilling of each 6 foot hole in this mine with water only was timed at 4–6 minutes, as compared to 45–70 seconds by using the air-water mist of the present invention. The U.S. Bureau of Mines ordered an independent test relative to respirable dust generated in drilling quartz sandstone; it was determined that a substantial reduction in respirable dust results from using the air-water jet mist over the use of air per se.

In comparing the air-water jet mist to prior art "water only" flushing, it should be emphasized that the present invention utilizes only about 3 qts./min./drill column as compared to 6–9 gals./min. resulting in water savings into the millions of gallons range per mine each year.

SUMMARY OF THE INVENTION

The invention is embodied in a rotary drilling system for drilling bores in rock, mineral and soft earth formations using a rotary drill bit with hard surface cutter means having outer bore-defining margins, and including a novel drive steel column and coupling assembly and secondary bore reamers to maintain design bore dimension.

It is an object of the present invention to provide a rotary drilling system that greatly reduces the amount of water required for effective hole flushing, that substantially reduces the amount of respirable dust in mining operations, that is able to accommodate drilling in all roof conditions, i.e. sandstone, limestone, shale, fractured rock and muddy seams, that can be used safely and effectively in methane environments, and that improves the quality of coal and working environment in coal mining. It is a further object to provide a novel drive steel column and coupling arrangement for quickly assembling and releasing the column sections or replacing drill bits, for ensuring delivery of flushing fluid without substantial pressure loss, and a still further object is to provide supplemental cutting means for maintaining bore dimensions and removing cuttings and fluid flow from the bore for more efficient drilling for long periods. These and other objects and advantages will become more apparent hereinafter.

BRIEF DESCRIPTION OF THE DRAWINGS

In the accompanying drawings which form a part of this specification and wherein like numerals refer to like parts wherever they occur.

BRIEF DESCRIPTION OF THE PREFERRED EMBODIMENTS

The present invention pertains generally to mining operations that include roof drilling, longwall mining and continuous mining in which water flushing is non-recoverable; and specifically the invention pertains to improvements in non-leak systems for delivering low volumes of flushing fluids while maintaining uniform and smooth bore sizing that provides better fluid flow for removing damp or muddy cuttings from the holes.

Figure 1:
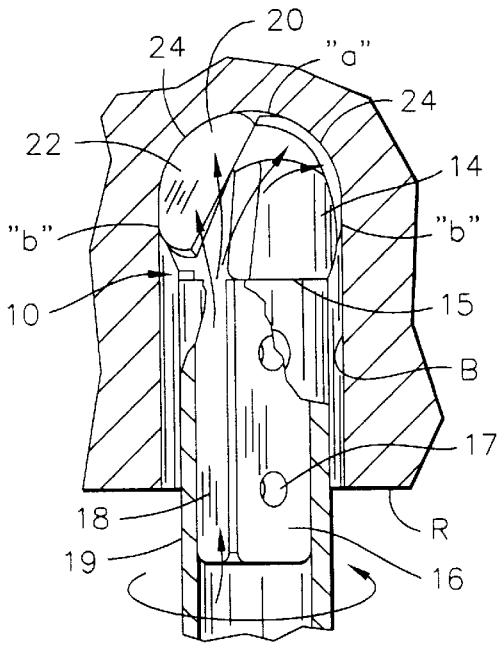
FIG. 1 is a side elevational view, partly broken away, showing one form of rotary drill bit useful in the present invention.

FIG. 1 shows one embodiment of my earlier non-coring roof drill bit as taught by my U.S. Pat. Nos. 5,180,022; 5,303,787 and 5,383,526—the disclosures of which are incorporated by reference herein as though fully set forth. Briefly stated, this non-coring roof drill bit 10 has a steel head portion 14 and shank portion 16 that is typically seated, at 15, on the end of a long rod drive steel 19 (119) of a drilling machine 76, such as a New Fletcher double boom roof bolter (shown in FIG. 6). The shank 16 and drive steel 19 have a complementary sliding fit and are cross-pinned together, as through coil spring or bolt holes 17, for co-rotational movement. The shank 16 has vertical water flutes 18 formed on opposite sides for channeling flushing fluids used for cooling and cleaning the cutter inserts 20 of the drill bit 10. These cutter inserts 20 are formed from a PCD disc cut into two semi-round halves that are applied to oppositely facing surfaces of the head portion 14, and the wear faces 22 of these inserts 20 both face in the direction of rotation and are positioned at negative rake and skew angles so that the cutter edges 24 perform a slicing action in cutting hard rock formations. The effective cutting arc of each insert is about 120° extending from beyond high entry point "a" at the axis past the gauge cutting outer margin at point "b". The insert 10 is non-coring since the cutter edges of the inserts 20 come substantially together at the axis of the drill bit to define a sinusoidal or S-shaped cutting arc across the diameter of the drill bit tool. This drill bit embodiment is shown drilling bore B in roof top R, and constitutes a long wearing drill bit that is especially successful in drilling through extremely hard rock formations.

Figure 2:
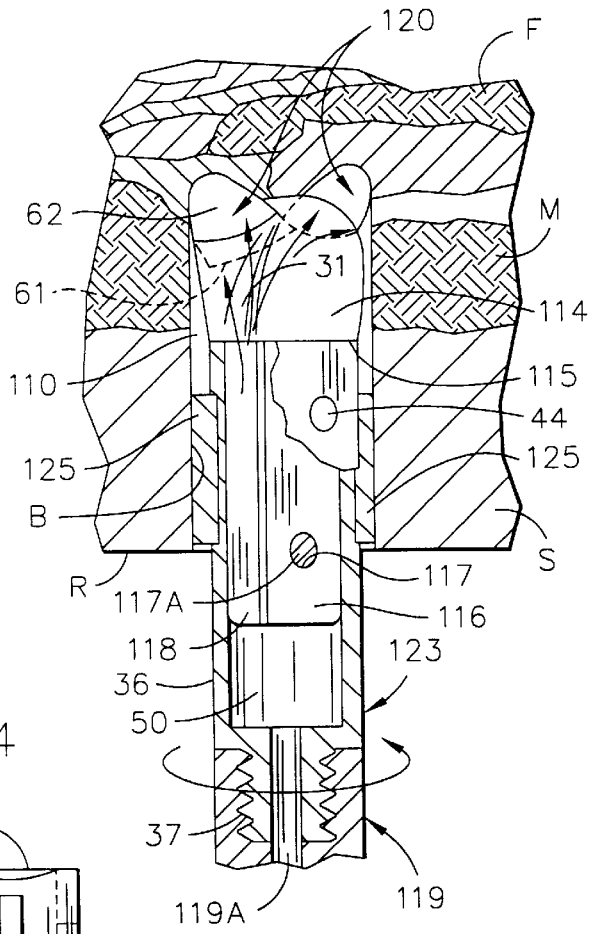
FIG. 2 is another side elevational view, partly broken away, illustrating another form of rotary drill bit and a bit coupler feature of the invention.

FIG. 2 shows one embodiment of my earlier coring roof drill bit as taught by my U.S. Pat. No. 5,535,839—the disclosure of which is incorporated by reference herein as though fully set forth. This coring-type drill bit 110 is shown connected through a bit coupler or mounting adapter 123 to a drive steel 119 and operates to drill bore B in the roof R as in a mine or tunnel. The roof top formation in FIG. 2 is lined to illustrate solid rock S, fractured rock or shale F and mud seams M. The drill bit 110 has a steel head mass 114 for seating and supporting hard surfaced cutter inserts 120, and the bit body also has a mounting shank 116 that is removably secured to the drive column of the drilling machine 76 (see FIG. 6). It will be understood that the drill bit 110 could be connected directly to the drive steel 119 (as in FIG. 1) for co-rotational movement together, but that mounting adapter or coupler 123 provides an improved coupling method that embodies a feature of the present invention. Thus, the body mass 114 has an annular shoulder 115 adapted to seat against the upper surface 28 of the adapter 123. The shank portion 116 of the drill bit in this embodiment is provided with the usual vertical water flutes 118 recessed inwardly on opposite sides of the shank and which serve to channel air/vacuum/liquid flushing fluids for cooling the cutter inserts 120 and cleaning away debris from the cutting area of the tool. In the FIG. 2 embodiment, the shank 116 of drill bit 110 has cross-bores 117 between opposed flat outer surfaces of the shank to receive fastening pins or bolts 117A.

The bit coupler or mounting adapter 123 of the invention has an elongate body 36 with a threaded stub 37 on its lower end 38 for removable threaded connection to the upper end of the drive steel 119. The outer body wall of the coupler 123 has opposed flat surfaces 40 for wrench engagement and a pair of arcuate surfaces 42 substantially complementary to the drive steel outer wall. Cross bores 44 are formed in flat walls 40 to match the cross-bores 117 in the drill bit shank 116 and receive the fastening pins 117A therethrough. The coupler 123 permits assembly and disassembly for replacing the drill bit 110 on the drive steel 119 with a minimum of unproductive downtime. An important function of the coupler 123 is to accommodate the flow of flushing fluid from the through-bore 119A of the drive steel to the head mass 114 and cutter inserts 120. To that end the coupler 123 has a central body chamber 50 that connects a through port or bore 52 in the threaded boss 37 to the drive steel chamber 119A. The central chamber 50 is constructed and arranged to receive the drill bit shank 116 with a sliding fit of the flat opposed shank walls to prevent relative rotation. In this assembled relationship, the head mass shoulder 115 seats on the upper end 28 of the coupler 123 and it should be noted that the lower end of the shank 116 is spaced above the floor 51 of central chamber 50 to define an open fluid receiving cavity for fluid distribution to the opposed shank flutes 118. This distribution and the vertical flow of flushing fluid upwardly through the coupler 123 is enhanced by providing vertical water flumes or canals 55 in the opposed walls 56 openly exposed to the shank water flutes 118.

As shown in FIG. 2, the coring-type drill bit 110 has at least two cutter inserts 120, each having a bullet-shaped carbide body with a cylindrical base 61 and an integral domed head 62 provided with a super-abrasive hard surfacing material such as PCD/CVD or nitride compositions of titanium, carbon and carbon boron. The rotary drill bit 110 has at least two of these radially domed PCD inserts 120 which are angularly seated in sockets in the head mass 114 so that the axis of each insert is pitched forwardly and outwardly at preselected rake and skew angles relative to the direction of rotation. The coring-type bit 110 of FIG. 2 is similar to the non-coring bit 10 of FIG. 1 in that the cutter inserts 120 are constructed and arranged on the head mass 114 to cut a predetermined bore gauge size, and an important feature of the invention is the provision of bore reamer means 125 associated with the bit coupler 123 and being constructed and arranged to follow after the cutter inserts (20, 120) to maintain the bore gauge size and remove cuttings from the bore-hole B, as will be described more fully.

Figure 6:
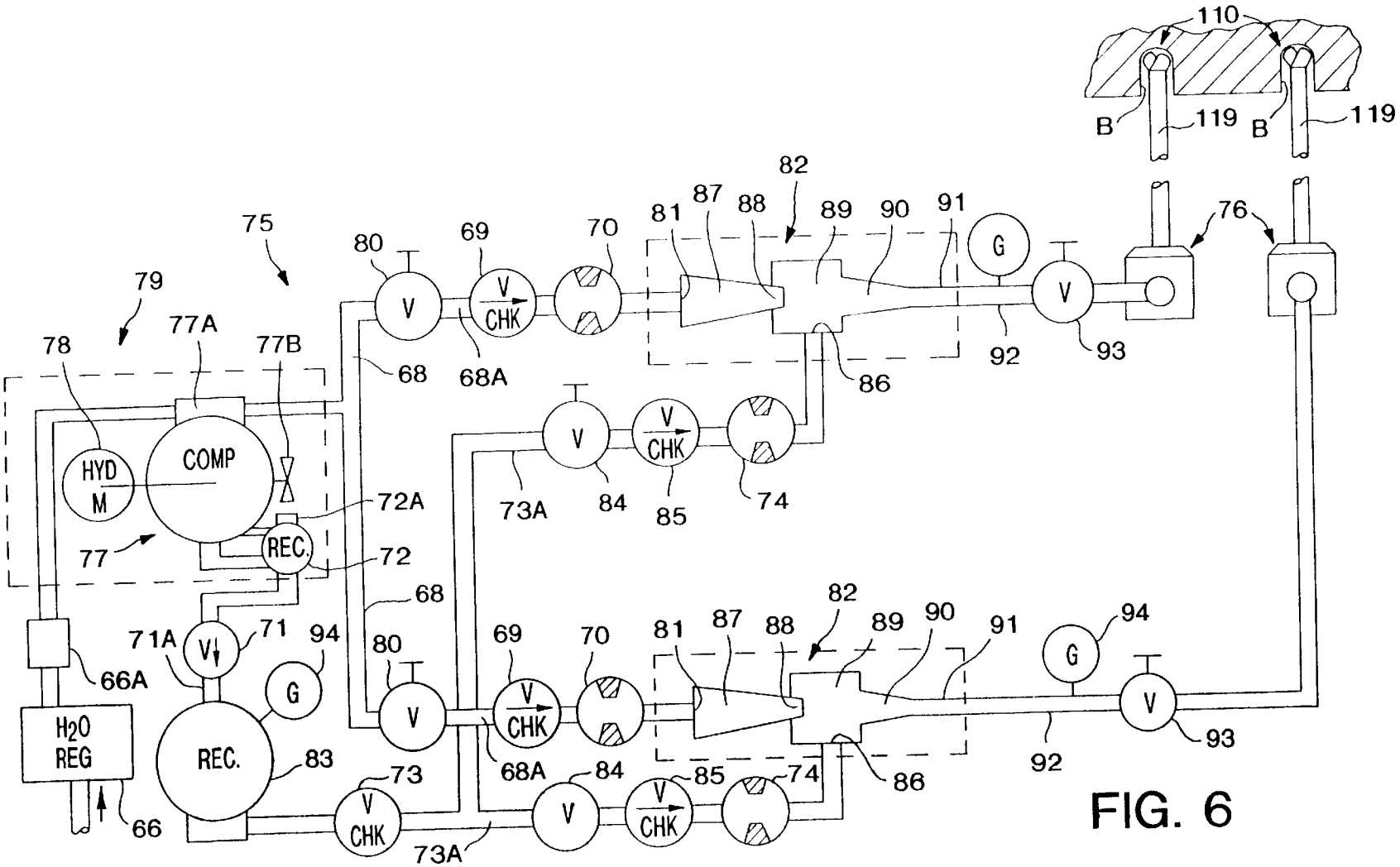
FIG. 6 is a diagrammatic view of the air-water jet drilling system of the invention.
Figure 19:
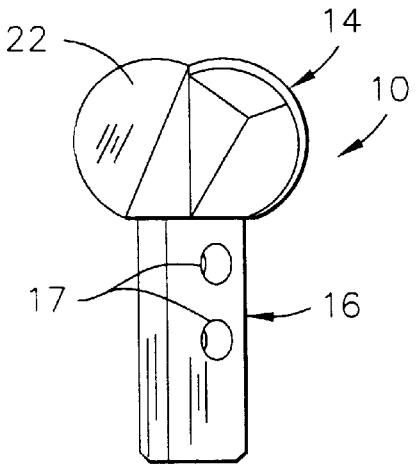
FIG. 19 is an elevational view of the rotary drill bit of FIG. 1.

My parent application Ser. No. 08/689,667 (U.S. Pat. No. 5,875,858) teaches low volume air-water drilling systems and methods to provide efficient irrigation and drill bit cooling using minimal amounts of water and improving mine safety conditions. A preferred embodiment of such a drilling system is shown in FIG. 6 in which the drilling system 75 uses a double boom New Fletcher roof bolter machine having two machine drives 76 operating vertical long rod drive steel columns 119 to rotationally drive roof drill bits 110, or the drill bits 10 (FIG. 1), 210 (FIG. 16) or 310 (FIG. 19). As will be readily apparent, the drilling system 75 has a separate flushing fluid handling network for each drilling column 119, although a common air-water source may be employed for double boom machines as will now be briefly summarized.

The system 75 is designed to provide an air-water mist as the flushing fluid for use in roof drilling and other mining operations where the fluid is non-recoverable. A water cooled compressor-pump 77 driven by a hydraulic motor 78 in a closed air cooled housing 79 is provided to assure a cold prime mover that will operate safely in coal mines or the like. The air compressor 77 has a water cooled head 77A receiving a flow of water at about 100–120 psi through inlet line 67 from a water source, and this flow of water coolant to the compressor 77 preferably constitutes the water source for the air-water mist of the system 75. Although the optimum static head line pressure is about 110–120 psi, it may be within the range of 70–150 psi. The water flows through the compressor head 77A and outlet line 68 to an adjustable water volume regulating valve 80 at the selected output line pressure, i.e. about 120 psi. From the adjustable water flow valve 80, the water is delivered through line 68A and one-way check valve 69 and an orifice port or restrictor 70 to the intake port 81 of an atomizing jet pump 82. The orifice control or restrictor 70 on the water supply side of the jet pump 82 is important to control the flow of water in the internal manifold area 89 of the jet pump so the water does not cut off the air intake and prevent admixing in this chamber. The volumetric flow rate of water through the flow valve 80 is in the range of 1–5 qt./min. with an optimum flow of about 3 qt./min. The orifice size selected for optimum operation is 3/32" or 7/64".

The air compressor 77 compresses ambient air and delivers it at a volumetric rate of about 30–35 cfm at about 120 psi past check valve 71 to a receiver tank 83 to form a compressed air source with a capacity of about 30 gallons. The compressor 77 is provided with an auto unloading valve 72A for unloading a small receiver 72 to relieve back pressure on the compressor for restart during cycling and as an added safety feature and improves the life of the compressor and the hydraulic motor coupling. From the main receiver 83, the air flows through a check valve 73 in line 73A to an adjustable air volume regulating valve 84 providing a constant air output volume in the range of 12.0 to 22.0 cfm at a pressure of about 100 to 120 psi. In a single drill system, 120 psi pressure can be easily maintained, but in a double boom unit 76 (as shown) the dynamic pressure may fall off to about 100 psi during constant operation. About 21 cfm at 100–120 psi has been found to be an effective optimum air pressure. Compressed ambient air is then delivered at a constant flow rate through another one-way check valve 85 and an orifice restrictor 74 to air intake port 86 of the jet pump 82. The orifice or restrictor size in the air line is about 3/32". Thus, both water and air are delivered into the large mixing chamber 89 of the jet pump 82 at about 120 psi through the respective orifice restrictors 70 and 74 thereby creating a turbulent admixture thereof.

The jet pump 82 typically operates on the principal of one fluid being entrained into a second fluid. Thus, water flow through a restrictor chamber 87 to a venturi or nozzle 88 produces a high velocity water jet discharge into and across the large manifold chamber 89, which also receives the air flow from inlet port 86 substantially at right angles. The high velocity water and air streams flowing into and through the chamber 89 are entrained and the flow of pressurized ambient air into the water stream causing the water particles to convert to an air-water mist, which is then pushed or carried forwardly into a diffuser section 90 and out to a discharge nozzle 91 connected to a fluid line 92 extending to the drive steel column 119 of the drilling machine 76. An operator on-off valve 93 and pressure gauges 94 are also provided.

In operation, coolant water is delivered to the jet pump at a pressure of 110–120 psi and compressed ambient air is delivered to the jet pump 82 at a pressure of 110–120 psi at a selected rate of about 21 cfm. The previous air-mist delivery pressures were too high, since cuttings from the bore hole (B) were coming out at about 31–34 cfm and deemed to be unsafe to work around. In the combined volumetric output of 12.016 and 22.4 cfm of air-water mist from the jet pump, the water content appears to be almost negligible in a ratio of about 1 to 150, but yet is efficient in the suppression of respirable dust particles generated during drilling and also highly efficient as a drill bit cooling fluid in that the water content is rapidly vaporized and dissipated by absorbing heat from the cutting elements. It is apparent that nonrecoverable water will result in a humid ambient atmosphere even if the ground surface water is almost eliminated and the present method employs this humid ambient air as an air source for compression and mixing with the lower water volume in the jet pump 82.

It is of great importance when working with optimum low volumes of air or air-water mist that there be no air loss or leakage in the system that would create problems such as insufficient air to flush cuttings from the drill hole B resulting in plugged drill bits and build up of cuttings, slowed penetration and premature bit wear. The present invention provides improvements in rotary drilling systems having a "no-leak" drill steel coupling and reamer means cooperatively constructed and arranged to deliver optimum drilling fluid flow and remove bore-hole cuttings.

Referring to FIGS. 7–16, reference numerals in the "200" series will be used in describing the drill steel column and reamer bit seat system 221 of the present invention.

Figure 7:
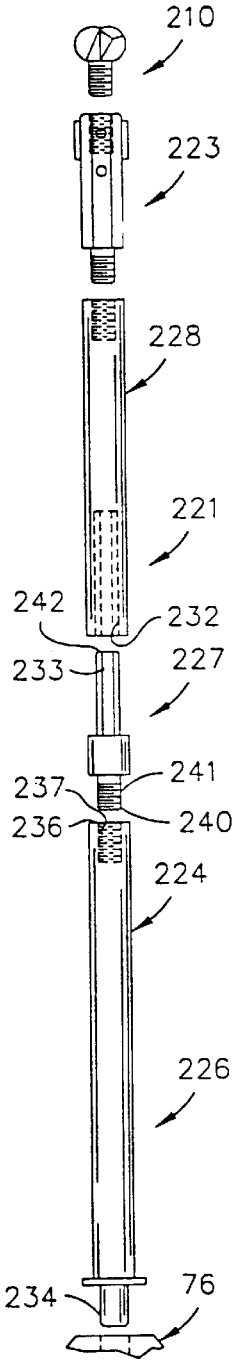
FIG. 7 is an exploded view of a drill steel column and coupling system embodying the invention.

Referring first to FIG. 7, a vertically oriented drill steel column and reamer bit seat system 221 embodying the invention is shown in exploded view and includes a drive steel starter member 226 (FIG. 8), a drive steel coupler member 227 (FIG. 9, 10), an extension member 228 (FIG. 11, 12) and a reamer bit seat or bit coupler member 223 (FIGS. 13–15) adapted to seat and couple drill bit 210 to the column 221. Typically, the drive steel column will have a substantially circular outer wall 230 with opposed longitudinal or axially disposed flats 231 to provide tool-engaging surfaces for assembly and disassembly, see FIGS. 10, 12 and 14.

A principal feature of the invention is to facilitate such assembly or disassembly while maintaining substantially air tight, sealed joints between the column members during drilling operations. In the past, drill steel and couplings have been threaded at both ends to assure a securely sealed non-leak connection, but threaded connections are time-consuming. As will now be seen, the invention utilizes a drive steel coupling system employing combinations of threaded ends and socket-type ends having multi-faced sides to provide a non-rotational slip-fit connection. In the preferred embodiment a hexagonal (i.e. hex) female end socket 232 on one drive steel or coupler member receives a mating hex male end plug 233 of the adjacent member, as shown best in FIGS. 9–12.

Figure 8:
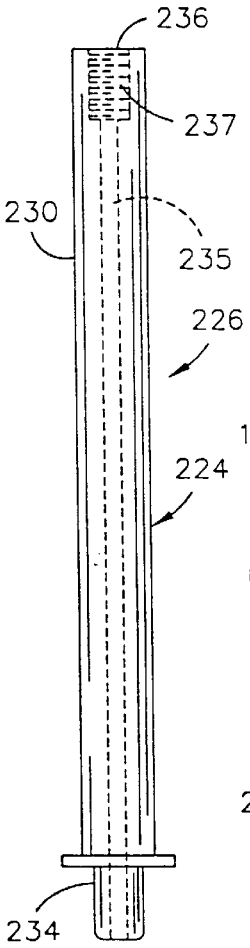
FIG. 8 is an enlarged elevational view of a drive steel member of the column and coupling system.

Referring to FIG. 8, the drive steel starter member 226 has a first or lower male plug end 234 of conventional configuration for driving connection in conventional chuck sealing grommet means (not shown) of the drilling machine (76). The elongated body 224 of the starter member 226 is of circular cross-section (230) with flats (231), and has an axial through-bore 235 from end to end. The upper second end 236 has an internally threaded female end socket 237.

Figure 9:
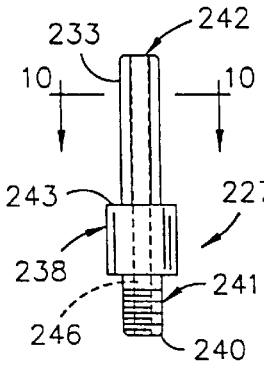
FIG. 9 is an enlarged elevational view of a steel coupling member of the system.
Figure 10:
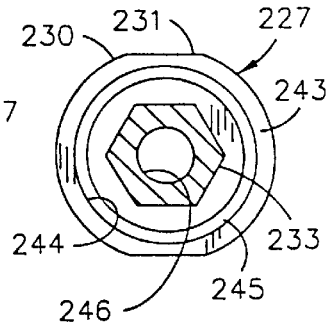
FIG. 10 is a greatly enlarged cross-sectional view taken along line 10—10 of FIG. 9.

A typical drive steel column may require one or more middle extension drive steel members so as to appropriately position the drill bit (210) for drilling engagement with the roof. In the past such extension members were threaded at both ends directly to the starter member and drill bit, or a short threaded coupler or adapter might be used to assemble the drill bit (110) on the extension or starter member. Referring to FIGS. 9 and 10, the half-threaded/half hex connecting system of the present invention uses a relatively short drive steel coupler member 227 for mounting the extension member 228 on the starter member 226. The coupler member 227 has a large central section 238 of similar cross-sectional configuration to the starter member 226, and a lower first end 240 formed as an exteriorly threaded male end plug 241 for sealed threaded engagement in the threaded upper end socket 237 of the driver 226. The upper second end section 242 of the coupler member 227 is formed as the male plug 233 having a hexagonal outer wall. The radial shoulder 243 between the central section 238 and upper male plug 233 has an annular groove 244 to seat an O-ring 245 (FIG. 10) for sealing engagement with the end of adjacent drive steel member (228). The coupler 227 has an axial through-bore 246 extending from end to end.

Figure 11:
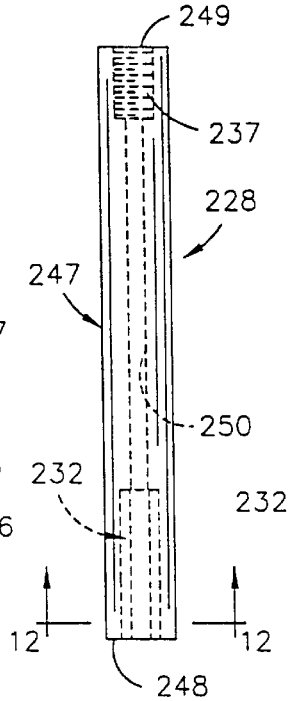
FIG. 11 is an enlarged elevational view of one form of a middle extension member of the system.
Figure 12:
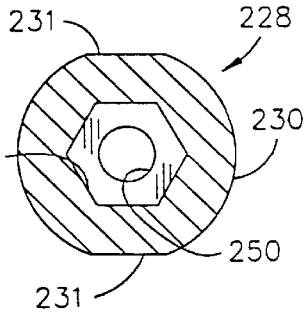
FIG. 12 is a greatly enlarged cross-sectional view taken along line 12—12 of FIG. 11.

Referring to FIGS. 11 and 12, one form of the middle extension member 228 has an elongate body 247 of similar cross-section to the starter member 226, and its lower first end is formed with the female end socket 232 of hexagonal section to receive the upper end plug 233 of the coupler 227 with a sliding fit and so that its lower end wall 248 is in sealing abutment with the O-ring 245. The extension member 228 has a through-bore 250 from end to end, and its upper second end 249 is counter-bored and threaded to form a threaded female socket 237.

Figure 16:
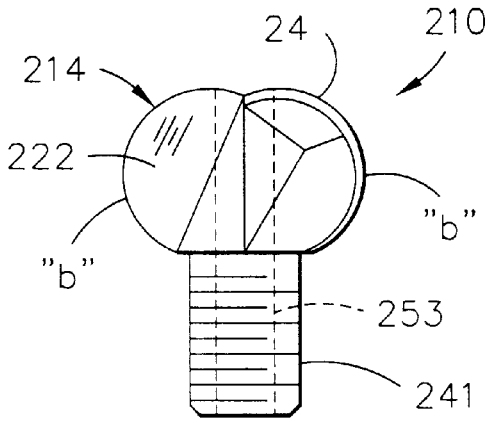
FIG. 16 is an enlarged elevational view of a typical rotary drill bit used with the system.
Figure 14:
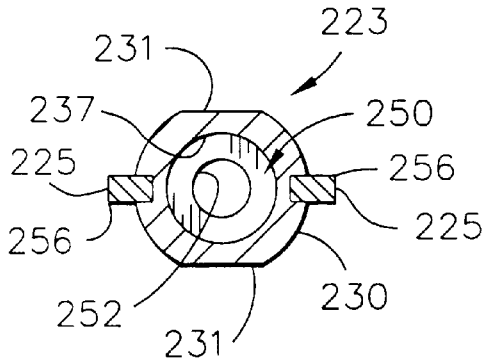
FIG. 14 is a cross-sectional view taken along line 14—14 of FIG. 13.
Figure 13:
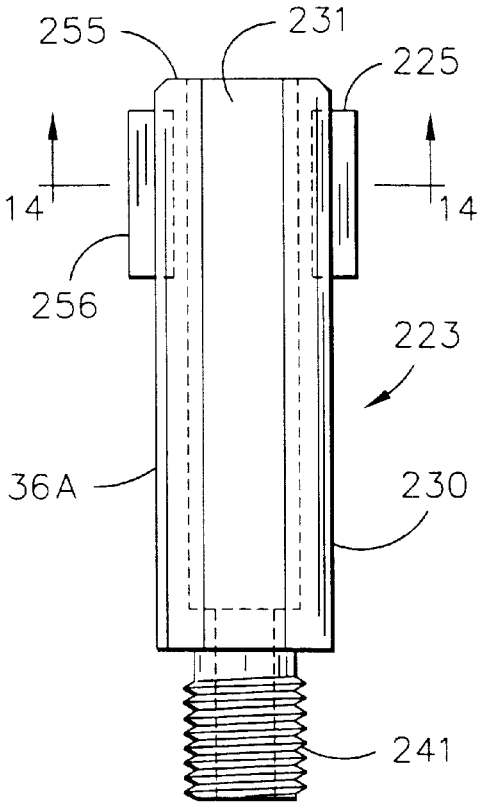
FIG. 13 is a greatly enlarged elevational view of one form of a reamer and bit coupler member of the invention.
Figure 15:
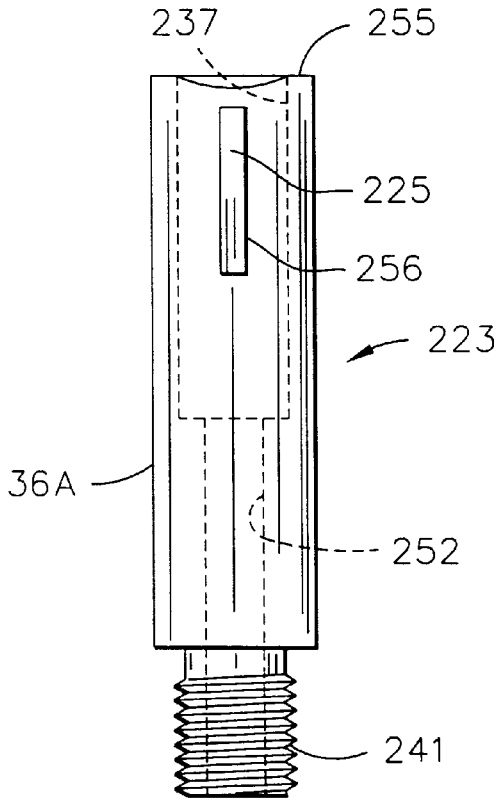
FIG. 15 is an elevational view of the reamer and bit coupler member as rotated 90° from FIG. 13.

Referring to FIGS. 13–15, this form of the reamer/bit coupler 223 has an elongate body 36A with a lower threaded male stub end 241 for removable threaded connection in the threaded female end socket 237 of the middle extension 228. The outer body wall of the coupler 223 has a generally cylindrical outer wall 230 similar to the other drive steel members and with the usual flats 231 for tool engagement. In this embodiment the coupler has an upper end 255 that is bored and threaded to form a threaded female socket 237 adapted to threadedly receive the threaded male shank 241 of a drill bit 210 (FIG. 16). It is here noted that the head portion 214 of the drill bit 210 is similar to that shown in FIG. 1, and that the threaded shank 241 has replaced the slip fit shank 16 of the FIG. 1 embodiment. The bit coupler 223 also has a through-bore 252 from end to end for delivery of flushing fluid through an axial port 253 in the shank 241 to the drill bit head 214, which is drilled and grooved or channeled in a typical manner for the flow of fluid from the port 253 to the entire head portion and cutting elements 222.

Still referring to FIG. 16, the outer cutting edges (24) of the cutting elements 222 extend in a sinusoidal curve across the axis of this non-coring drill bit 210—as previously described with reference to the drill bit 10 of FIG. 1—and have outer gauge-cutting margins (at "b") which define the bore hole size being drilled. It will be understood that the cutting margins of the tool will wear away through continued use even though the cutting edges are "self-sharpening" (as described in my earlier patents cited and incorporated herein). In other words, even though the drill bit tool is still useful for drilling operations after some wear on the cutting elements, it would have had to be replaced in the past in order to assure that all bore holes being drilled (as in roof bolting operations) were of the proper size.

The present invention accommodates extended drilling operations with the same drill bit by providing the reamer means (125, 225) on the bit coupler (123, 223). The reamer elements 125, 225 are preferably arranged in pairs on opposite outer sides of the bit coupler body 36A to extend from the upper end 255 in an axially extending longitudinal direction, and it will be understood that three or more reamer elements may be utilized. Clearly, the reamer elements 225 project outwardly from the bit coupler side wall and have reamer edges 256 at the same preselected bore-hole gauge as the gauge-margins "b" of the drill bit 210.

In operation, the drill steel column 221 is assembled on the drilling machine with the appropriate threaded and hex socket connections between the respective members and couplers to position the drill bit (10, 110, 210) at the location to be drilled. Although drilling rotational speeds may be varied, the drive column and drill bit are always under compression to assure tight sealing between members so that drilling fluids are delivered to the drill bit head with no appreciable loss or pressure drop—particularly with the low air-water misting system of applicant's invention. As the drilling progresses, the drill bit head 14, 214 will continue to drill into the wall structure and the resulting cuttings should be flushed outwardly by the drilling fluids to clean the bore-hole B which, of course, is easier in roof boring than in side wall operations and obviously easier with higher volumes of drilling fluids. In the present invention - which employs half threaded and half hex coupling combinations and low volumes of air and water—it is imperative that there are no leaks in the system or the problems of premature bit wear, plugged drill bits, slow penetration and the like will result because of insufficient flushing action.

The reamer/bit seat coupler 223 (and drive steel column) drives the drill bit 10, 110, 210 rotationally into the wall R to form the bore-hole B and the reamer elements follow into the bore-hole and act as a secondary drill bit to maintain bore gauge and help remove loose cuttings from the hole. Thus, the reamer bit seat is extremely valuable in roof bolting operations to assure that the hole for roof bolts is the proper dimension and not rifled (as most holes currently are), and is clean so that installation of resin and roof bolts is facilitated.

Figure 17:
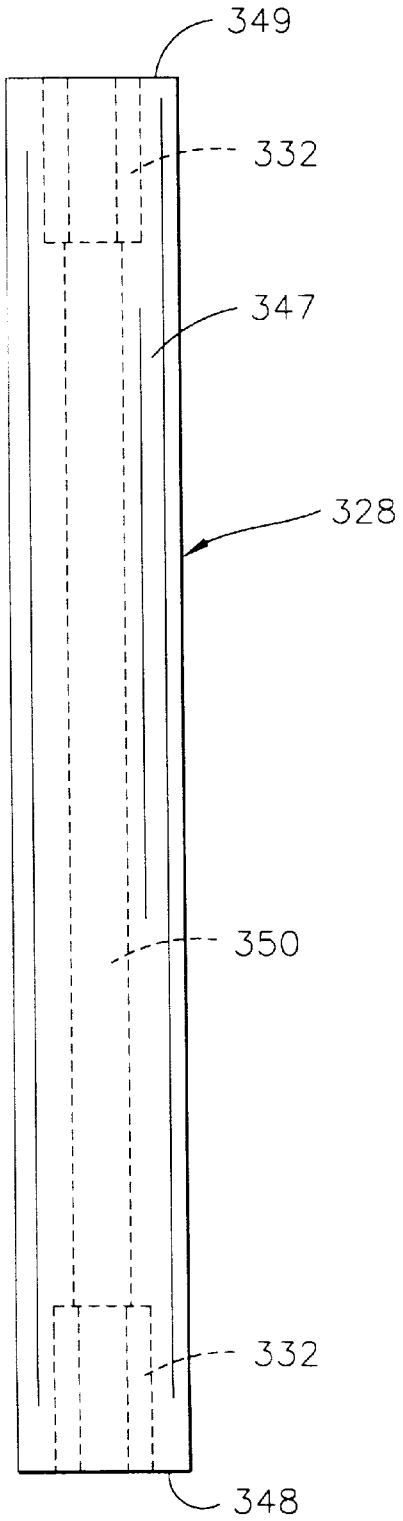
FIG. 17 is a greatly enlarged elevational view of another form of a middle extension member.
Figure 18:
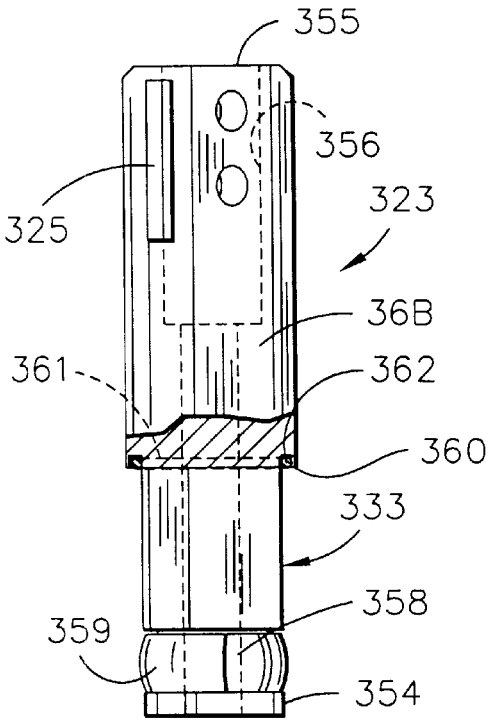
FIG. 18 is an enlarged elevational view of another form of a reamer/bit coupler embodying the invention.

Referring now to FIGS. 17–19, another form of the reamer bit seat coupler 323 is illustrated with the drill bit 10 of FIG. 1, and a modified form of the middle extension member 328. While one feature of the drive steel column is the sealed integrity of the flushing fluid delivery conduit therethrough, it is another feature to provide a quick release connection so that the drill bit and/or reamer bit seat coupler can be changed over (replaced) as and when needed. In the column 221 of FIG. 7 the only quick release (i.e. pull apart) connection shown is the half-hex fit between the coupler 227 and extension member 228; and the reamer bit seat 223 and drill bit 210 are both threadedly connected. The modified middle extension 328 has the usual elongate body 347 with a through-bore 350 between its lower and upper ends 348, 349. However, both of these ends are provided with hexagonal female sockets 332 (232) for mating engagement with the complementary hex male plug 233 of the coupler 227 on the lower end and with the hex male plug 333 of bit seat coupler 323 on its upper end.

Figure 3:
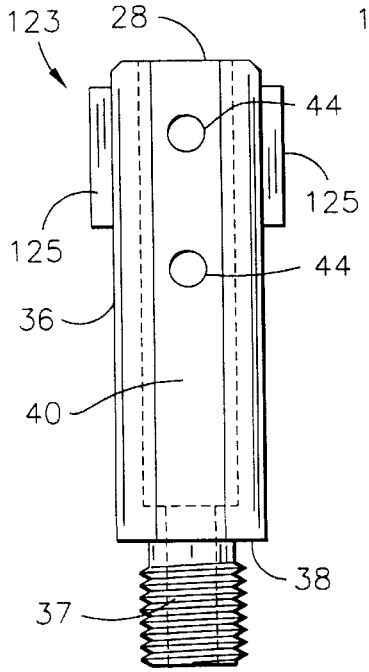
FIG. 3 is a side elevational view of the bit coupler as rotated 45° from FIG. 2.
Figure 4:
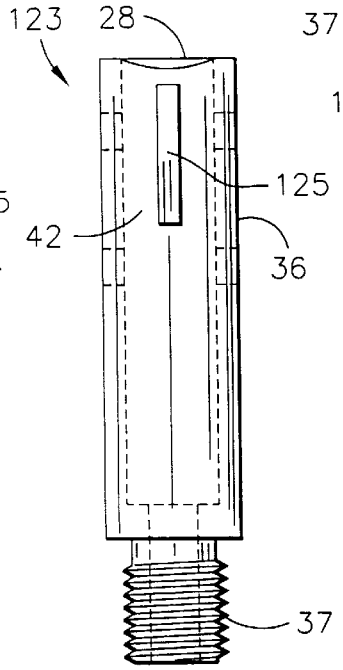
FIG. 4 is a side elevational view of the bit coupler as rotated 90° from FIG. 3.
Figure 5:
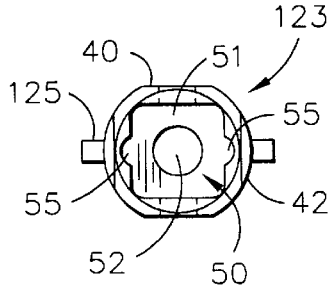
FIG. 5 is a top plan view of the bit coupler.

The reamer bit seat 323 has an elongate body 36B with the hexagonal male plug or shank 333 on its lower end 354 for sliding slip fit in the hex upper end socket 332 of the middle extension 328. An annular recess 358 is formed adjacent to the lower end 354 and a compression spring 359 is carried in the recess for outward bearing engagement against the extension socket walls to normally maintain assembly of the retainer bit seat 323 with the extension 328 while permitting quick release separation when a change over is mandated. The shoulder 360 between the body section 36B and lower shank portion 333 has an annular recess 361 and seats an O-ring 362 adapted for sealing compressive engagement by the upper end 349 of the extension 328. The upper end 355 has a recess 356 like the bit seat 50 of FIGS. 3–5 to receive the lower mounting shank 16 of the drill bit 10 (FIG. 19), but it will be understood that this shank may be further modified with a hexagonal cross-section similar to the upper male plug 233 (FIG. 9) for similar slip fit mating connection with a complementary hex socket 332 in the upper end of the bit seat 323. In either case, the bit seat coupler 323 is also provided with reamer elements 325 secured in elongate milled slots in opposite sides of the body portion 36B and projecting outwardly therefrom to meet design gauge objectives. It should be noted that the reamer elements 125, 225, 325 have a substantial length so that their effective or useful wear life will be longer.

It is known that threaded drill steel connections are standard, and are effective leak-proof means to insure fluid delivery without substantial pressure drop through a drill steel column. The use of hexagonal slip-fit connections in the present invention are also designed to be reliable in preventing fluid losses. Thus, hex connections are primarily placed on the high pressure (upper end) side of a member in the fluid flow direction from the male plug of a lower member directly into the through-port of a mating upper member. A jetting action thus takes place with the tendency to create a low pressure or vacuum zone surrounding the male plug so that air is sucked in at the joint rather than fluid loss occurring. Although the hex joint connection between the extension 328 and reamer bit seat 323 is on the upper low pressure side of the extension member 328, this joint is substantially at the end of the fluid delivery system in which fluid is discharged over the drill bit head portion 14 for cleaning and cooling action. Therefore, no appreciable pressure loss or drop occurs through the system to the point of the point of discharge.

It is now apparent that the objects and advantages of the present invention have been met. Changes and modifications of the disclosed forms of the invention will become apparent to those skilled in the mining tool art, and the invention is only to be limited by the scope of the appended claims.

What is claimed is:

1. A rotary drilling system comprising a sectional drive steel column for connecting a drilling machine and a rotary drill bit for cutting bores of a predetermined gauge size, said drive steel column comprising a drive steel member with a multi-faced female socket end and a first coupler member with a complementary multi-faced male stud end for sliding slip-fit engagement in said female socket, said drive steel and coupler members being constructed and arranged to accommodate the internal flow of flushing fluid without substantial pressure loss by having the male stud end projecting into the female socket in the direction of flushing fluid flow, other coupling means for seating the drill bit thereon for co-rotational drilling movement with the drive steel column to cut the bore, and including other cutting means associated with said other coupling means adjacent to the drill bit seat thereon for maintaining bore gauge during drilling operations.

2. The drilling system of claim 1, in which said drill bit has cutter means with outer cutter margins constructed and arranged for the primary cutting of the predetermined bore size, and said other bore cutting means is mounted on the other bit coupling means adjacent to said outer cutter margins of said drill bit for providing secondary bore gauge maintenance.

3. The drilling system of claim 2, in which said outer cutter margins of said drill bit form a bore size larger than the outer circumference of said other bit coupling means, and said other bore cutting means comprises at least two cutting elements mounted on the bit coupler to project radially outwardly therefrom and extend longitudinally in an axial direction away from the drill bit cutter means.

4. The drilling system of claim 2, in which the cutter means of the drill bit have a super-abrasive surface, and the other bore cutting means are formed of a relatively softer material.

5. The drilling system of claim 5, in which the softer material is tungsten carbide.

6. The drilling system of claim 1, in which said drive steel column includes at least two drive steel members having first and second ends and axial through-bores, and said first coupler member interconnects said drive steel members and has a connecting axial through-bore, said first coupler member having its upper end section downstream, in the direction of flushing fluid flow in its through-bore, formed as the multi-faced male stud end with the adjacent lower connecting end of the upper drive steel member being formed with the complementary multi-faced female socket for receiving the male stud end of the coupler member therein, and said first coupler means having other connecting means on its lower end section, in the upstream direction of flushing fluid flow in its through-bore, constructed and arranged for sealed connection with the upper end of the lower drive steel member.

7. The drilling system of claim 6, in which the lower drive steel members comprises an elongated drive steel starter member having its lower end formed with an external surface constructed and arranged for releasable, rotationally driven engagement with the drilling machine, and being connected through said first coupler member with a releasably slip-fit engagement with the upper drive steel member.

8. The drilling system according to claim 6, in which said first coupler member has an enlarged central section, and the shoulder formed between the enlarged section and said upper end section being provided with means for sealing engagement by the lower end of the upper drive steel member.

9. The drilling system of claim 8, in which the means for sealing comprises an annular groove recessed into said shoulder and an O-ring seal for abutment by the lower end surface of the upper drive steel member.

10. The drilling system of claim 6, in which the upper drive steel member comprises an extension member between the first coupler member and the other bit coupling means.

11. The drilling system of claim 6, in which the upper drive steel member comprises an extension member between the first coupler member and the other bit coupling means, said bit coupling means having a lower end formed as a multi-faced male stud and the upper end of said extension member having a complementary multi-faced female socket for connection therewith.

12. In combination with a rotary drilling system having a drive steel column and a rotary drill bit constructed and arranged for cutting a primary bore of predetermined gauge size, the improvement comprising bit coupler means releasably connecting the drill bit to the drive steel column, and having secondary bore cutting means secured in the outer wall of the coupler means closely adjacent to the drill bit for providing secondary bore gauge maintenance during drilling operations.

13. The combination of claim 12, in which said outer cutter margins of said drill bit form a bore size larger than the outer circumference of said bit coupler means, and said other bore cutting means comprises at least two cutting elements mounted on the bit coupler means to project radially outwardly therefrom and which are elongated in an axial direction extending away from the drill bit cutter means.

14. The combination of claim 12, in which the cutter means of the drill bit have a super-abrasive surface, and the other bore cutting means are formed of a relatively softer material.

15. The combination of claim 14, in which the softer material is tungsten carbide.

16. A rotary drilling system comprising a sectional drove steel column for connecting a drilling maching and a rotary drill bit for cutting bores of a predetermined gauge size, said drive steel column comprising at least two drive steel members having first and second ends and axial through-bores, a first coupler member interconnecting said drive steel members and having a connecting axial through-bore, said first coupler member having its upper end section formed as a multi-faced male stud and the adjacent lower connecting end of the upper drive steel member being formed with a complementary multi-faced female socket for sliding a slip-fit engagement with the male stud, said first coupler member having other connecting means on its lower end section constructed and arranged for sealed connection with the upper end of the lower drive steel member, said drive steel and first coupler members being constructed and arranged to accommodate the internal flow of flushing fluid without substantial pressure loss by having the male stud end projecing into the female socket in the direction of flushing fluid flow, and other coupling means for seating the drill bit for co-rotational drilling movement with the drive steel column to cut the bore of predetermined gauge.

17. The drilling system of claim 16, in which the lower drive steel member comprises an elongatyed drive steel starter member having its lower end formed with an external surface constructed and arranged for releasable, rotationally driven engagement with the drilling machine, and the second upper end being releasably connected to the lower end of said first coupler member.

18. The drilling system according to claim 16, in which said first coupler member has an enlarged central section, and the shoulder formed between the enlarged section and said upper end section being provided with means for sealing engagement by the lower end of the upper drive steel member.

19. The drilling system of claim 18, in which the means for sealing comprises an annular groove recessed into said shoulder and an O-ring seal for abutment by the lower end surface of the upper drive steel member.

20. The drilling system of claim 16, in which the upper drive steel member comprises an extension member between the first coupler member and the bit coupling means, said bit coupling means having a lower end formed as a threaded male stud and said means for releasably connecting comprises an internally threaded female socket.

21. The drilling system of claim 16, in which the upper drive steel member comprises an extension member between the first coupler member and the other bit coupling means, said bit coupling means having a lower end formed as a multi-faced male stud and the upper end of said extension member having a complementary multi-faced female socket for connection therewith.

* * * * *